US005660757A

United States Patent [19]

Smith

[11] Patent Number: 5,660,757

[45] Date of Patent: Aug. 26, 1997

[54] ADVANCED FEED TIP NOZZLE FOR TWIN ROLL CASTER

[75] Inventor: Dennis M. Smith, Crestline, Calif.

[73] Assignee: Hunter Engineering Co., Inc., Riverside, Calif.

[21] Appl. No.: 522,974

[22] Filed: Sep. 1, 1995

[51] Int. Cl.[6] ..... B22D 41/50; B22D 11/10

[52] U.S. Cl. ..... 222/591; 164/437; 164/428

[58] Field of Search ..... 222/590 OR, 591; 164/428, 437, 438, 439, 480, 488

[56] References Cited

U.S. PATENT DOCUMENTS

| | | | |
|---|---|---|---|
| 3,430,683 | 3/1969 | Hood, Jr. | 164/281 |
| 4,217,947 | 8/1980 | Gyöngyös et al. | 164/437 |
| 4,232,804 | 11/1980 | Lewis et al. | 222/591 |
| 4,303,181 | 12/1981 | Lewis et al. | 222/591 |
| 4,641,767 | 2/1987 | Smith | 222/591 |
| 4,705,466 | 11/1987 | Balassa | 425/6 |
| 4,716,956 | 1/1988 | Hoffman et al. | 164/480 |
| 4,811,781 | 3/1989 | Romanowski et al. | 164/480 |
| 5,435,375 | 7/1995 | Eckert | 164/437 |

*Primary Examiner*—Joseph J. Hail, III
*Assistant Examiner*—I. H. Lin
*Attorney, Agent, or Firm*—Christie, Parker & Hale, LLP

[57] ABSTRACT

A molten metal feed tip nozzle for a continuous roll caster is made by combining a pair of elongated feed tip nozzle members with a non-aggressive buffer pad. The feed tip nozzle members are spaced apart a sufficient distance to allow molten metal to pass through the downstream edges to engage the surfaces of the caster rolls. The buffer pad is secured to an outside face of each feed tip nozzle member along the downstream edge. The buffer pad comprises at least an outside face which is less aggressive than the material forming the feed tip nozzle members for minimizing scratching of the rolls. Preferably, an upstream portion of the buffer pad contains a material that expands upon heating for conforming the outside of the pad to the surface of the adjacent roll.

18 Claims, 3 Drawing Sheets

ADVANCED FEED TIP NOZZLE FOR TWIN ROLL CASTER

BACKGROUND

Typically, continuous casting of molten aluminum, lead, zinc, and the like are conducted in commercial scale operations using a continuous casting process such as shown in U.S. Pat. Nos. 2,790,216 or 4,054,173. These patents are incorporated herein by this reference. A continuous caster process typically comprises a pair of rotating water cooled caster rolls in which molten metal is routed through a feed tip nozzle into the rotating caster rolls just prior to the line of closest approach of the caster rolls. Heat is rapidly extracted from the molten metal by contact with the water cooled caster rolls and the molten metal freezes as it comes into contact with the water cooled caster rolls. The solid metal is compressed as it passes through the gap between the caster rolls with the thickness of the emerging metal defined by the narrowest spacing between the caster rolls. The thin sheets of metal emerge from the caster rolls with a width of a couple of meters and a thickness of about one to six millimeters (depending upon the actual spacing of the caster rolls). The casting process occurs at approximately one to four meters per minute and each run can last for several days at a time.

An important part of the casting process is the feed tip nozzle which delivers molten metal directly into the gap between the two caster rolls as shown in U.S. Pat. Nos. 4,232,804 and 4,303,181. These patents are incorporated herein by this reference. This process often causes the top face and bottom face of the feed tip nozzle to come directly into contact with the caster rolls. Typically, the feed tip nozzle is made of material harder and more aggressive than the steel caster roll material, such as aluminum oxide or aluminum oxide-silicon oxide fibers The interaction between the moving caster rolls and the hard feed tip nozzle causes scratches to be embedded into the softer caster rolls.

These embedded scratches in the caster rolls, in turn, are applied to the metal after the metal freezes and when the metal passes through and is compressed to conform to the thickness defined by the narrowest gap between the caster rolls. The end result is the production of a continuous sheet of metal with scratch marks typically represented by raised ridges extending above the intended thickness of the sheet of metal as defined by the narrowest gap between the caster rolls.

Currently, the only way to eliminate the scratch marks transferred to the sheet of metal during the roll casting process is to use a feed tip nozzle that has little or no flexing; is able to resist absorption of water; and has the thermal and strength characteristics required to successfully cast nonferrous metals. At the moment, there are no advanced materials on the market that can be used to manufacture such a scratch-free feed tip nozzle.

BRIEF SUMMARY OF THE INVENTION

It is therefore desirable to provide a buffer pad that attaches to the top and bottom sides of the feed tip nozzle, adjacent to the caster rolls, that economically and successfully prevents scratch marks from being embedded into the caster rolls, and in turn, transferred to the metal sheets. The introduction of the buffer pad into the continuous casting process also reduces direct friction between the feed tip nozzle and the pair of caster rolls. This addition extends the life of both the feed tip nozzle and the pair of caster rolls. In addition, absorption of water-based release agents into or directly on the surface of the feed tip nozzle is minimized.

The invention comprises a metal feed tip nozzle for a continuous caster with a buffer pad comprising a layer of ceramic fiber sandwiched in between top and bottom layers of fiberglass cloth. The materials used for the buffer pad are softer than the materials used to produce the feed tip; are capable of withstanding temperatures above 260° C. (500° F.); and are durable enough to maintain their original consistency during the continuous caster operation. A purpose of a buffer pad is to act as a medium and/or envelope to protect and to prevent the aggressive feed tip nozzle from making contact with the twin caster rolls during and prior to the continuous casting operation.

DETAILED DESCRIPTION

Figure 1:
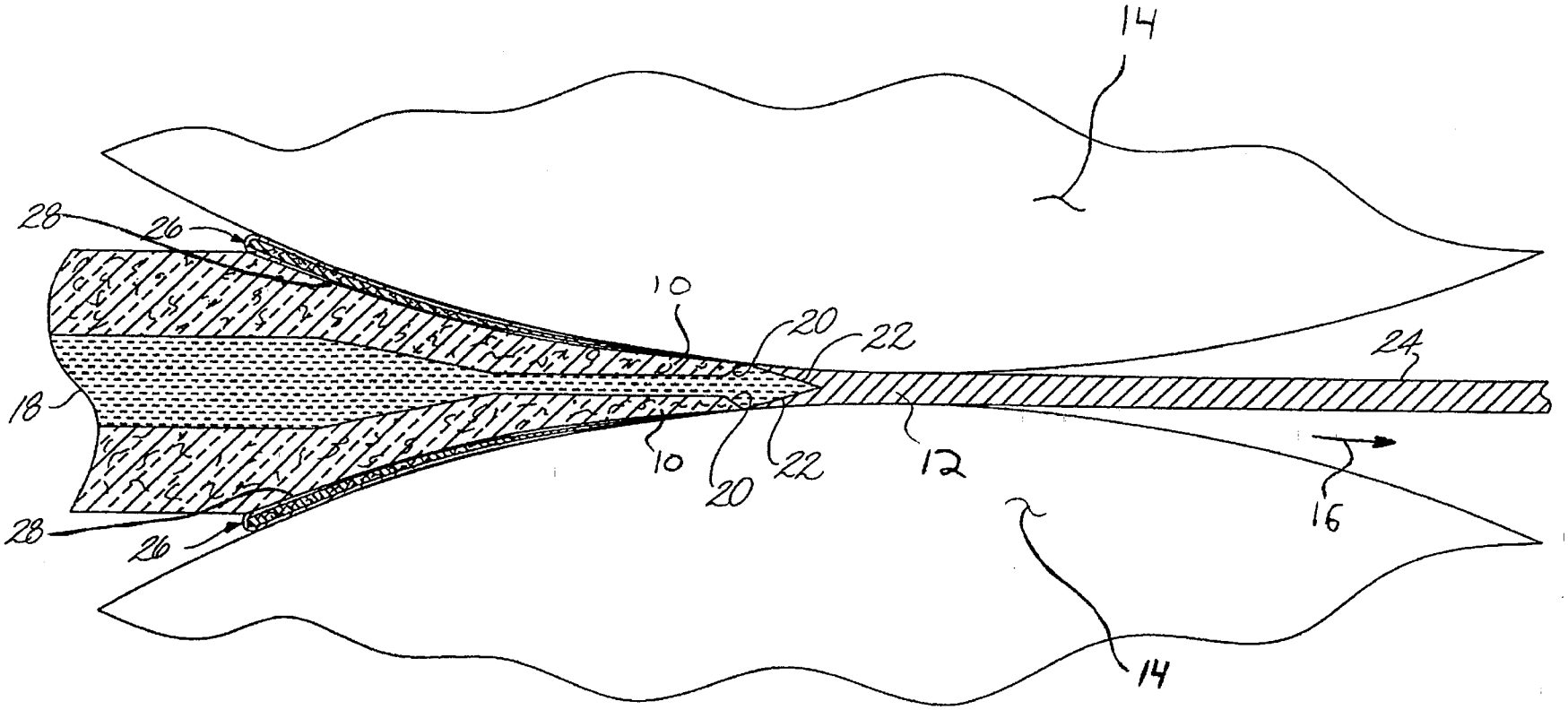
FIG. 1 illustrates in transverse cross section a molten metal feed tip nozzle for a twin caster roll.

FIG. 1 illustrates in transverse cross section elements of a continuous casting operation. Molten metal is funneled through a pair of feed tip nozzle members 10 into a gap 12 between a pair of water cooled caster rolls 14. The axes of the pair of caster rolls are parallel and are driven in the direction of metal movement 16 through the continuous operating caster.

The molten metal 18 emerges from the downstream edge 20 of the pair of feed tip nozzle members 10 and increases in cross section to engage the surfaces of the pair of caster rolls 14. Heat from the molten metal is extracted by the water-cooled caster rolls 14, and freezing occurs in a narrow zone 22 upstream from the gap 12 between the caster rolls 14 and the downstream edges 20 of the pair of feed tip nozzle members. The solid metal moves downstream and passes through the gap 12 between the slowly rotating pair of caster rolls and is reduced in thickness equal to the gap between the caster rolls. A continuous sheet of metal 24 leaves the pair of caster rolls opposite the side where the pair of feed tip nozzle members feed the molten metal.

The downstream edges of the pair of feed tip nozzle members are spaced apart to provide a continuous opening extending along the length of the caster rolls with the opening having a total length corresponding approximately to the desired width of the sheet being cast. Conventional flaring end dams (not shown) close off both ends (not shown) of the feed tip nozzle and help define the width of the sheet being cast. The width of the sheet prepared in a manufacturing operation can differ from time to time and the maximum is dependent on the length of the caster rolls. A width of 1½ to 2 meters is common. The feed tip nozzle member is therefore made from a plurality of segments (individual segments not shown) with each segment typically extending 15 centimeters along the length of the caster rolls. Thus, a greater or lesser number of segments can be assembled to form the feed tip nozzle member with a desired width for the continuous caster rolls. This much of the feed tip nozzle is conventional.

An improvement to the continuous caster process comprises an insulating buffer pad 26 that attaches to the outside face 28 of an assembled feed tip nozzle member adjacent to the down stream edge 20. The buffer pad 26 prevents direct contact between the outside face 28 of the feed tip nozzle member and the pair of rotating caster rolls 14. This forced separation prevents the caster rolls from being scratched by the outside face of the feed tip nozzle member.

Figure 3:
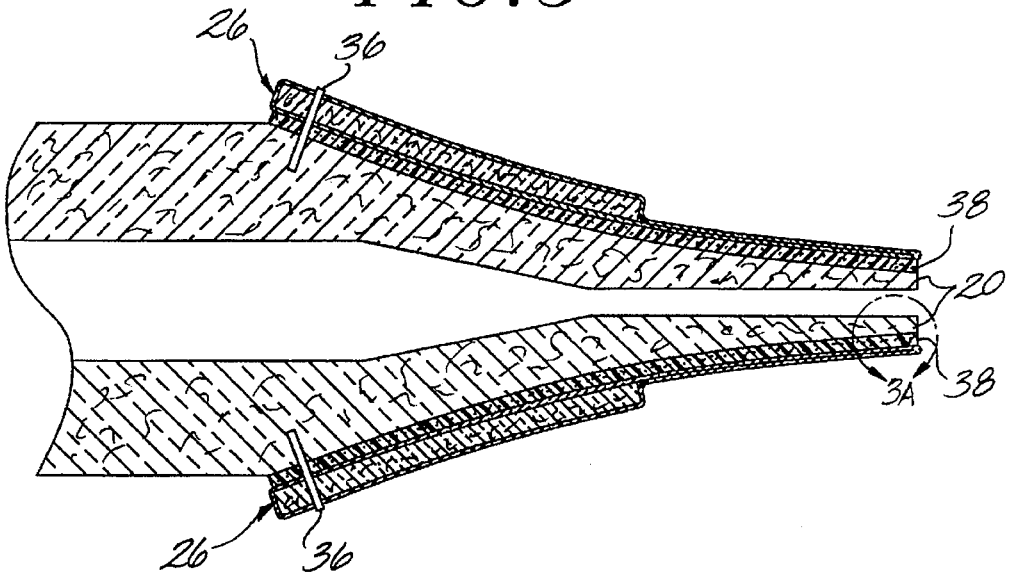
FIG. 3 illustrates in cross section a means by which an insulating pad attaches to a refractory member forming a feed tip nozzle.

In this embodiment the buffer pad 26 attaches to the outside face of the feed tip nozzle member by a plurality of staples 36 (see FIG. 3). An alternative technique for attaching the buffer pad to the outside face of the feed tip nozzle is by organic glue 38. An additional technique for attaching the buffer pad to the outside face of the feed tip nozzle is by both a plurality of intermittent staples 36 and organic glue 38. The organic glue typically burns off in use and the staples provide adequate holding once the feed tip nozzle has been placed in service. A "glue" comprising colloidal silica may also be used.

Figure 4:
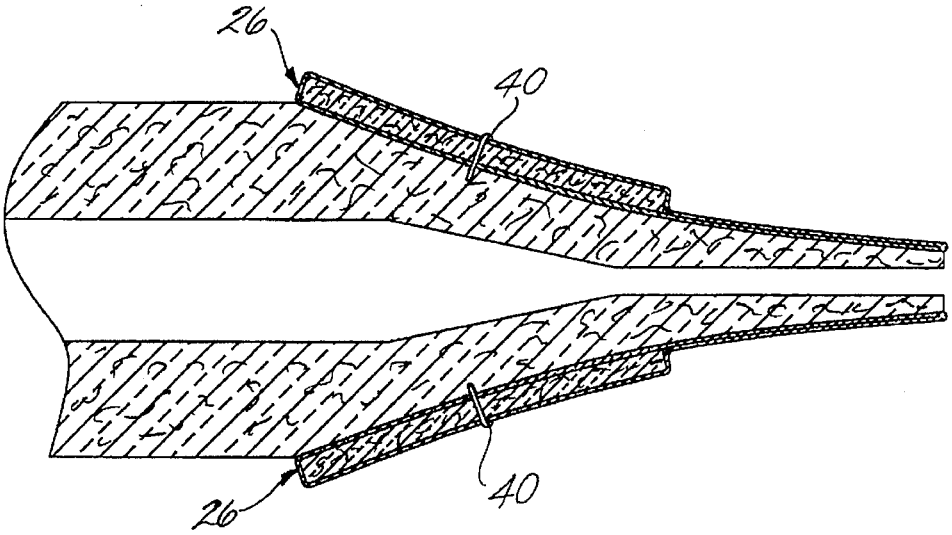
FIG. 4 illustrates in cross section an alternative means by which an insulating pad attaches to a refractory member forming a feed tip nozzle.

Another alternative technique to attach the buffer pad 26 to the outside face of the feed tip nozzle is by industrial fiber glass stitching 40 (see FIG. 4). This maintains a controlled pattern of connection and eliminates gasses which are released by organic glue when heated.

An additional technique for attaching the buffer pad to the outside face of the feed tip nozzle is by pressing the buffer pad directly into the surface of the outside face of the feed tip nozzle as the feed tip nozzle is being molded. Typically the feed tip nozzle is made from a felt of refractory fibers (alumina and silica), the felt being made by dispersing said fibers in an aqueous solution containing a dispersion of colloidal silica such that the resultant slurry maintains 5% by weight of said fibers. A felt blanket is formed by immersing a felting screen into the slurry and connecting a vacuum suction to the underside, allowing the felt fibers to accumulate on the surface of the felting screen.

The felt blanket is placed into a die cavity (not shown) and the cavity is closed by a mating die member (not shown) after the buffer pad is placed on top of the felt fibers in a position adjacent to the eventual downstream edge of the feed tip member. The assembly is pressed at a pressure insufficient to cause substantial fiber breakage to compress the felt blanket to the desired geometry of one moiety of the continuous feed tip nozzle and to press the buffer pad into the felt blanket. This process is conventional except for addition of the buffer pad.

An alternative technique for attaching the buffer pad to the outside face of the feed tip nozzle is by applying a silica based glue to the side of the buffer pad to be attached to the feed tip nozzle and then pressing the buffer pad into the feed tip nozzle by the molding press technique described above.

The feed tip member thickness is approximately 2.2 mm at the downstream edge of each feed tip member with a 4 to 5 mm gap between the pair of feed tip members from which the molten metal flows. Typically there is less than a 5.5 mm gap between caster rolls at the downstream edge of the caster rolls. To accommodate the attached buffer pad the downstream edge of the pair of feed tip nozzles is moved back upstream far enough to compensate for the increase in thickness the buffer pad adds to the feed tip nozzle when attached.

The buffer pad 26 is formed into a generally rectangular shape, the length being defined by the length of the assembled feed tip nozzle members whose length, in turn, is dependent upon the predetermined length of the caster rolls. The width of the buffer pad is approximately determined by the area on the outside face of the feed tip nozzle member that would otherwise come into contact with the rotating caster roll. In a preferred embodiment of the buffer pad the upstream portion of the buffer pad 26 comprises a single layer of ceramic fiber 32 material, approximately 0.50 mm (0.020 inch.) thick, sandwiched in between a pair of tight-weave sheets of fiberglass cloth 34, approximately 0.19 mm (0.0075 inch) thick (see FIG. 2). The downstream portion of the buffer pad comprises a double layer of the tight-weave sheets of fiberglass cloth 34. A thin layer of ceramic fiber "paper" 39 may also be included between the sheets of fiberglass cloth as shown in FIG. 3A.

Figure 2:
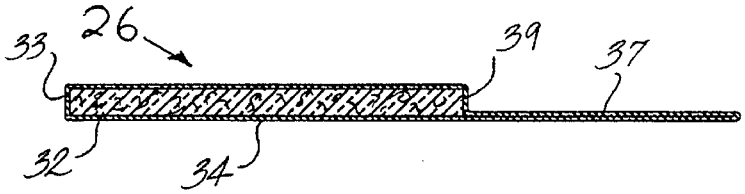
FIG. 2 illustrates in transverse cross section an insulating buffer pad.
Figure 3A:
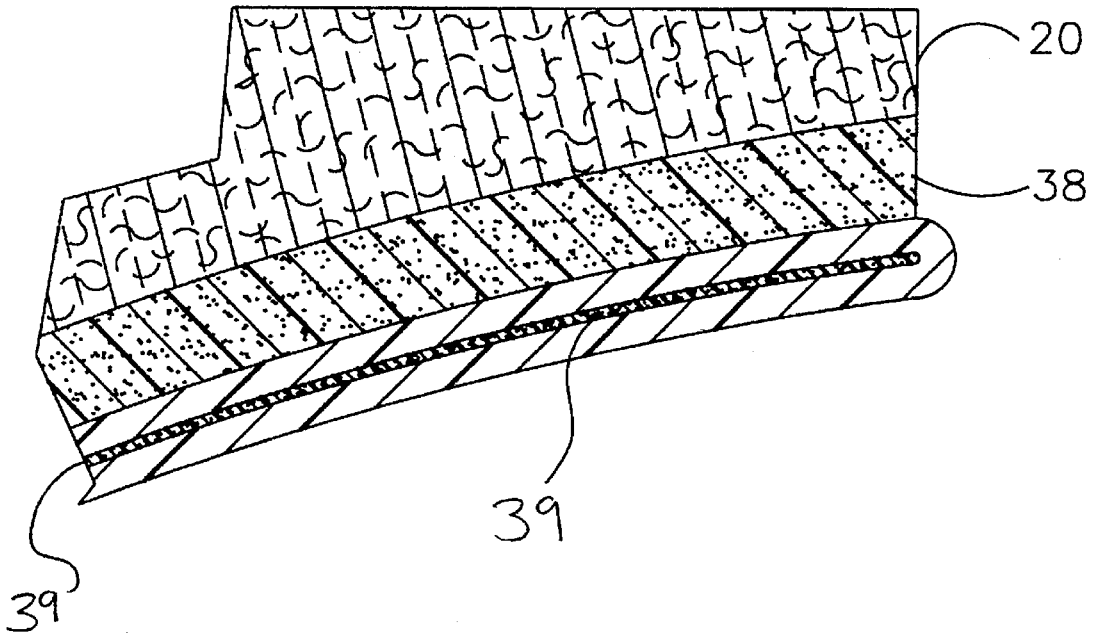
FIG. 3A is an enlarged cross sectional view of the insulating pad of FIG. 3 enlarged to show a thin layer of ceramic fiber "paper" between sheets of fiberglass cloth.

The upstream edge 33 of the ceramic fiber begins approximately ½ mm (the thickness of the fiberglass cloth 34) from the upstream edge of the buffer pad and extends downstream approximately 3.8 cm (see FIG. 2). The downstream portion 37 of the buffer pad comprising two layers of fiberglass cloth without the ceramic fiber material extends approximately 2.5 cm from the downstream edge 39 of the ceramic fiber to the downstream edge of the feed tip nozzle member 20. At the downstream edge of the feed tip member the fiberglass cloth is folded and ironed to form a crease that runs adjacent to the downstream edge of the feed tip member.

The closely woven fiberglass fabric on the surface of the buffer pad is smoother and less aggressive or abrasive than the ceramic fiber surface of the feed tip nozzle. The fabric on the buffer pad produces much less scratching of the rolls than the material of the feed tip nozzle. The feed tip has random orientations of fibers and protruding ends can readily abrade the caster roll surfaces. The silica of the fiberglass is smoother and less abrasive than the alumina ceramic fibers commonly employed for making feed tips. The fibers also tend to lie closer to tangent to the rolls and abrasive fiber ends against the roll surfaces are thereby minimized.

The layer of ceramic fiber material 32 comprises a paper-like material that includes a temperature resistant vermiculite-type mineral composition which expands upon being heated. A suitable material is available from Standard Oil Engineered Materials, Niagara Falls, N.Y., under the trademark Fiberfrax XPE or XPE/970.

A buffer pad made from this material is approximately flat (albeit stepped) when secured along the edge of the feed tip nozzle. When heated by molten aluminum upon first use of the feed tip, the vermiculite in the gasket material expands and the outer face of each buffer pad engages the surface of the adjacent roll. The surface of the pad conforms to the curvature of the roll and forms a close "seal" to the roll. The downstream portion of the buffer pad comprising the two layers of fiberglass cloth allows the buffer pad to taper off in conformity with the shape of the caster rolls and the downstream edge of the feed tip nozzle member.

The buffer pad not only provides a smoother, less aggressive surface against the roll which minimizes scratching, but also helps maintain an inert atmosphere adjacent the molten metal by reducing the presence of oxygen which can shorten the life expectancy of the buffer pad. The gasket material also reduces the overall flexing of the feed tip nozzle, thus further reducing the likelihood of a feed tip nozzle scratching a pair of caster rolls.

What is claimed is:

1. A feed tip nozzle for a continuous roll caster comprising:

a pair of elongated feed tip nozzle members spaced apart along a downstream edge of the nozzle a sufficient distance for molten metal to pass and engage surfaces of rolls in a continuous roll caster; and a buffer pad secured to an outside face of each nozzle member along the downstream edge, the buffer pad comprising at least an outside face which is less abrasive than material forming the feed tip nozzle members, wherein the buffer pad comprises a material which conforms by expansion to a surface of an adjacent caster roll upon heating.

2. The feed tip nozzle according to claim 1 wherein the buffer pad comprises an outside surface layer comprising woven fiberglass fabric.

3. The feed tip nozzle according to claim 1 wherein the buffer pad comprises a composition comprising ceramic fibers and a material that expands upon heating.

4. The feed tip nozzle according to claim 3 wherein the material that expands upon heating comprises a vermiculite-type mineral.

5. A feed tip nozzle for a continuous roll caster comprising:

a pair of generally rectangular refractory members each having a downstream edge and an upstream edge, each of the members being formed of a felt of refractory fibers;

a buffer pad on an outside face of at least one refractory member adjacent to the downstream edge, the buffer pad comprising:

an upstream edge and a downstream edge;

a combination of heat resistant materials smoother and less abrasive than materials used in manufacture of the refractory members, wherein the buffer pad comprises a layer of ceramic fiber sandwiched between a top layer and a bottom layer of woven fiberglass fabric; and means for attaching the buffer pad to the outside face of a refractory member.

6. The feed tip nozzle as recited in claim 5 wherein the buffer pad further comprises a layer of material that expands when heated, sandwiched between the top layer and a bottom layer of the woven fiberglass fabric.

7. The feed tip nozzle as recited in claim 5 wherein the means for attaching the buffer pad comprises a plurality of staples attaching the buffer pad to the outside face of the refractory member.

8. The feed tip nozzle as recited in claim 5 wherein the means for attaching the buffer pad comprises glue attaching the buffer pad to the outside face of the refractory member.

9. The feed tip nozzle as recited in claim 5 wherein the means for attaching the buffer pad comprises a plurality of staples and glue attaching the buffer pad to the outside face of the refractory member.

10. The feed tip nozzle as recited in claim 5 wherein the means for attaching the buffer pad comprises fiberglass stitching attaching the buffer pad to the outside face of the refractory member.

11. The feed tip nozzle as recited in claim 5 wherein the buffer pad is formed directly on the outside face of the refractory member simultaneous with the refractory member being molded.

12. The feed tip nozzle as recited in claim 5 wherein the buffer pad is pressed into the outside face of the refractory member as the refractory member is being molded.

13. A feed tip nozzle for a continuous roll caster comprising:

a pair of generally rectangular refractory members each having a downstream edge and an upstream edge, each of the members being formed of a felt of refractory fibers rigidly bonded together; and a buffer pad on an outside face of at least one refractory member adjacent to the downstream edge, the buffer pad comprising:

a heat resistant material smoother than materials used in manufacture of the refractory member for bearing against an adjacent roll of the roll caster, an upstream portion comprising a layer of ceramic fiber material sandwiched between layers of the heat resistant material; and a top and bottom layer of fiberglass cloth, a downstream portion comprising a top layer and a bottom layer of heat resistant material; and means for attaching the buffer pad to the outside face of a refractory member.

14. The feed tip nozzle as recited in claim 13 wherein the heat resistant material comprises fiberglass cloth.

15. The feed tip nozzle according to claim 13 wherein the ceramic fiber material comprises a material which expands upon heating.

16. The feed tip nozzle according to claim 13 wherein the upstream portion of the buffer pad comprises a material which conforms to a surface of an adjacent caster roll upon heating.

17. The feed tip nozzle according to claim 13 wherein the ceramic fiber material comprises a composition comprising ceramic fibers and a material that expands upon heating.

18. The feed tip nozzle according to claim 17 wherein the material that expands upon heating comprises a vermiculite-type mineral.

* * * * *